US006696633B2

(12) United States Patent
Miyagishima et al.

(10) Patent No.: US 6,696,633 B2
(45) Date of Patent: Feb. 24, 2004

(54) ELECTRONIC TONE GENERATING APPARATUS AND SIGNAL-PROCESSING-CHARACTERISTIC ADJUSTING METHOD

(75) Inventors: Satoshi Miyagishima, Hamamatsu (JP); Shinichi Sawara, Kosai (JP); Akira Miki, Hamamatsu (JP); Fukushi Kawakami, Hamakita (JP); Yasutake Suzuki, Iwata (JP); Takeo Shibukawa, Toyoda-cho (JP)

(73) Assignee: Yamaha Corporation, Hamamatsu (JP)

( * ) Notice: Subject to any disclaimer, the term of this patent is extended or adjusted under 35 U.S.C. 154(b) by 0 days.

(21) Appl. No.: 10/330,731

(22) Filed: Dec. 27, 2002

(65) Prior Publication Data

US 2003/0121403 A1 Jul. 3, 2003

(30) Foreign Application Priority Data

Dec. 27, 2001 (JP) ..... 2001-398103

(51) Int. Cl.[7] ..... G10H 1/02

(52) U.S. Cl. ..... 84/737; 381/59; 381/103

(58) Field of Search ..... 84/735, 737, 741; 381/103, 107, 95, 96, 59

(56) References Cited

U.S. PATENT DOCUMENTS

| | | | | | |
|---|---|---|---|---|---|
| 3,506,773 | A | * | 4/1970 | George | 84/699 |
| 4,592,088 | A | * | 5/1986 | Shimada | 381/96 |
| 4,694,498 | A | * | 9/1987 | Suzuki et al. | 381/103 |
| 5,248,846 | A | * | 9/1993 | Koike et al. | 84/718 |
| 5,506,910 | A | * | 4/1996 | Miller et al. | 381/103 |
| 5,768,398 | A | * | 6/1998 | Janse et al. | 381/103 |
| 6,111,957 | A | * | 8/2000 | Thomasson | 381/15 |
| 6,157,724 | A | | 12/2000 | Kawakami | |
| 6,434,240 | B1 | * | 8/2002 | Kulas | 381/89 |

* cited by examiner

*Primary Examiner*—Jeffrey Donels
(74) *Attorney, Agent, or Firm*—Pillsbury Winthrop LLP

(57) ABSTRACT

As an electronic tone is generated in response to performing operation, the electronic tone is picked up by microphones corresponding to left and right channels, and picked-up sound signals thus generated by the microphones are then subjected to signal processing, such as reverberation impartment utilizing acoustic conditions of the interior of a room. Picked-up sound signals having undergone such signal processing are audibly reproduced via rear speakers. Then, once an automatic adjustment instruction is given from a user, measuring tones are reproduced stereophonically, and contents of the signal processing of the individual channels are adjusted on the basis of measured results of picked-up sound signals generated by the microphones picking up the reproduced measuring tones.

11 Claims, 8 Drawing Sheets

FREQUENCY CHARACTERISTIC
IN OPEN LOOP

SMOOTHING

| INSTALLATION ENVIRONMENT | SETTING INFORMATION |
|---|---|
| INSTALLATION ENVIRONMENT A | SETTING INFORMATION A |
| INSTALLATION ENVIRONMENT B | SETTING INFORMATION B |
| INSTALLATION ENVIRONMENT C | SETTING INFORMATION C |
| INSTALLATION ENVIRONMENT D | SETTING INFORMATION D |
| INSTALLATION ENVIRONMENT E | SETTING INFORMATION E |
| ⋮ | ⋮ |

ELECTRONIC TONE GENERATING APPARATUS AND SIGNAL-PROCESSING-CHARACTERISTIC ADJUSTING METHOD

BACKGROUND OF THE INVENTION

The present invention relates to an electronic tone generating apparatus and signal-processing-characteristic adjusting method for use with the apparatus which can impart an acoustic feel, sounding effects peculiar to a natural musical instrument, etc. to tones to be generated, utilizing acoustic conditions of the interior of a room or other space in which the electronic tone generating apparatus is installed.

The acoustic feedback system has been known which performs tone control, such as extension of reverberation, on the basis of existing indoor acoustic conditions in an electric acoustic manner, and principles of such an acoustic feedback system are illustratively shown in FIG. 1. In the acoustic feedback system of FIG. 1, a speaker 12 and microphone 14 are installed an appropriate distance from each other in the interior of a room 10, a tone picked up by the microphone 14 is supplied, as a picked-up tone signal, to an FIR (Finite Impulse Response) filter 18 via a head amplifier 16, to thereby generate a reverberation signal (primarily, initial reflected sound signal). Then, the generated reverberation signal is output via an amplifier 20 to the speaker 12, so that the amplified reverberation signal is audibly reproduced by the speaker 12 and the thus audibly-reproduced tone is again picked up by the microphone 14. By repeating such a sequence of the tone processing, the acoustic feedback system permits increase in a tone volume feeling (i.e., increase in a tone pressure level), increase in a reverberation feeling (i.e., extension of a reverberation time), increase in an expansion feeling (i.e., increase in sideways reflected sound energy), etc. Thus, with the acoustic feedback system, it is possible to crease a sound field feeling as if tones were being performed in a large hall or other large space, although the room 10 is small in fact.

Sound field control apparatus employing the above-mentioned acoustic feedback principles perform processing to adjust frequency characteristics of picked-up tone signals generated by the microphone 14 picking up tones, in order to secure stability against undesired howling. Contents of the frequency characteristic correction process, to be performed on the picked-up tone signals generated by the microphone 14, would differ depending on installed conditions of the microphone 14 and speaker 12. Thus, where the sound field control apparatus used is of a type designed to perform only predetermined contents of the frequency characteristic correction process, it can not carry out appropriate signal processing if there has occurred a change in the installed conditions of the sound field control apparatus, which would invite inconveniences such as howling. Even in the case where the sound field control apparatus used is of a type capable of varying the frequency characteristic correction process as required, it is necessary for the user to adjust, after installation of the control apparatus, the contents of the frequency characteristic correction process through manual operation in accordance with the installed conditions of the apparatus.

SUMMARY OF THE INVENTION

In view of the foregoing, it is an object of the present invention to provide an electronic tone generating apparatus and signal-processing-characteristic adjusting method for use with the apparatus which can impart an acoustic feeling etc. to a tone to be generated using acoustic conditions in the space of an existing room, and which can also automatically prevent inconveniences, such as howling, even when an installation environment etc. of the apparatus have changed.

In order to accomplish the above-mentioned object, the present invention provides an electronic tone generating apparatus comprising an electronic tone generator for generating tone signals of a first channel and second channel, and a first speaker and second speaker for audibly reproducing tones corresponding to the tone signals of the first channel and second channel, respectively, generated by the electronic tone generator. The electronic tone generating apparatus further comprises: a first microphone provided at a position corresponding to the first speaker; a second microphone provided at a position corresponding to the second speaker; a first signal processing section that performs predetermined signal processing on a picked-up sound signal generated by the first microphone picking up a sound and thereby outputs a processed picked-up sound signal; a second signal processing section that performs predetermines signal processing on a picked-up sound signal generated by the second microphone picking up a picked-up sound and thereby outputs a processed picked-up sound signal; a third speaker, provided at a position corresponding to the first speaker, for audibly reproducing a sound corresponding to the processed picked-up sound signal output by the first signal processing section; a fourth speaker, provided at a position corresponding to the second speaker, for audibly reproducing a sound corresponding to the processed picked-up sound signal output by the second signal processing section; and a setting section that, when an instruction for setting contents of signal processing is given, supplies a measuring sound signal to the third speaker and fourth speaker, and sets contents of the signal processing to be performed by the first signal processing section on the basis of a picked-up sound signal generated by the first microphone during a predetermined measuring period when sounds corresponding to the measuring sound signal are being audibly reproduced by the third speaker and fourth speaker, and contents of the signal processing to be performed by the second signal processing section on the basis of a picked-up sound signal generated by the second microphone during the predetermined measuring period.

In the electronic tone generating apparatus thus arranged, as tones corresponding to tone signals of two channels are audibly reproduced, i.e. as stereo reproduction of the two-channel tone signals (including monaural reproduction of a same tone signal through two channels) is performed, the audibly-reproduced tones are picked up by the first and second microphones to generate picked-up tone signals, then the picked-up tone signals of the first and second microphones are processed by the first and second signal processing sections, respectively, and then the resultant processed picked-up tone signals output from the first and second signal processing sections are audibly reproduced via the third and fourth speakers, respectively. Namely, if each of the first and second signal processing sections performs a reverberation impartment process etc., there can be achieved reverberation impartment etc. utilizing acoustic characteristics of an installation environment, such as the shape of a space, in which the tone generating apparatus of the invention is installed; namely, there can be achieved the so-called "acoustic feedback". Thus, the present invention can faithfully reproduce sounding effects peculiar to a natural musical instrument, reverberation produceable in a space surrounding a performing stage, etc. Generally, in the case where the acoustic feedback is utilized, it is necessary to adjust contents of processing to be performed by the first and second signal processing sections, in accordance with the installation environment of the apparatus. However, the tone generating apparatus of the invention is arranged to automatically adjust the contents of the processing by means of the setting section once an instruction for adjusting the contents is given. Here, the contents adjustment is performed on the basis of measured results of stereophonically-reproduced two-channel measuring sounds, namely, the contents of the processing to be performed by each of the signal processing sections are adjusted on the basis of the measured result including signal components of the other channel, with the result that the adjustment can be performed taking into account acoustic inconveniences likely to be caused by from crosstalk and the like.

The present invention also provides an electronic tone generating apparatus comprising an electronic tone generator for generating a tone signal, and a main speaker for audibly reproducing a tone corresponding to the tone signal generated by the electronic tone generator. The electronic tone generating apparatus further comprises: a microphone provided at a position corresponding to the main speaker; a signal processing section that performs predetermined signal processing on a picked-up sound signal generated by the microphone and thereby outputs a processed picked-up sound signal, the signal processing section including a first equalizer, FIR filter and second equalizer; an auxiliary speaker for audibly reproducing a tone corresponding to the processed picked-up sound signal output by the signal processing section; and a setting section that, when an instruction for setting contents of signal processing is given, sets contents of the signal processing to be performed by the signal processing section. The setting section performs adjustment processing in an open loop condition where the signal processing section is interrupted at a given interrupting point thereof and during a time period in which the auxiliary speaker is being caused to audibly reproduce a sound by receiving a measuring sound signal input via the interrupting point. The adjustment processing in the open loop condition measures a frequency characteristic of a picked-up sound signal generated by the microphone and fed back to the interrupting point of the signal processing section, then corrects the measured frequency characteristic on the basis of a picked-up signal generated by the microphone while audible sound reproduction by the main speaker and auxiliary speaker is stopped, and then adjusts a characteristic of the first equalizer of the signal processing section so that a measured frequency characteristic of a sound signal after correction of the measured frequency characteristic by the setting section becomes a flat characteristic. The setting section also performs adjustment processing in a closed loop condition where a signal passage loop of the signal processing section is closed and during a time period in which the auxiliary speaker is being caused to audibly reproduce a sound by receiving the measuring sound signal input via the interrupting point. The adjustment processing in the closed loop condition measures a frequency characteristic of a picked-up sound signal generated by the microphone, then corrects the measured frequency characteristic on the basis of a picked-up signal generated by the microphone while audible sound reproduction by the main speaker and auxiliary speaker is stopped, and then adjusts a characteristic of the second equalizer of the signal processing section so that a frequency characteristic of a picked-up sound signal generated by the microphone after correction of the measured frequency characteristic by the setting section becomes a flat characteristic.

In the electronic tone generating apparatus thus arranged, as tones corresponding to tone signals are audibly reproduced, each of the audibly-reproduced tones is picked up by the microphone to generate a picked-up tone signal, then the picked-up tone signal is processed by the signal processing section, and then the thus-processed picked-up tone signal is audibly reproduced via the auxiliary speaker. Namely, if the signal processing section performs a reverberation impartment process etc., there can be achieved reverberation impartment etc. (in other words, "acoustic feedback") utilizing acoustic characteristics of an installation environment, such as the shape of a space, in which the tone generating apparatus of the invention is installed. Thus, the present invention can faithfully reproduce sounding effects peculiar to a natural musical instrument and reverberation produceable in a space surrounding a performing stage. Generally, in the case where the acoustic feedback is utilized, it is necessary to adjust contents of processing to be performed by the signal processing section, in accordance with the installation environment of the apparatus. However, the tone generating apparatus of the invention is arranged to automatically adjust the contents of the processing by means of the setting section once an instruction for adjusting the contents is given. Here, the contents adjustment is performed on the basis of measured results of a measuring sound actually reproduced. Because the present invention corrects the measured results on the basis of measured results obtained when the apparatus was not generating a tone at all (i.e., on the basis of measured results of background noise) and then uses the thus-corrected measured results in the contents adjustment processing, it can perform the adjustment processing with an increased accuracy.

According to another aspect of the present invention, there is provided a method for adjusting signal processing characteristics of a first signal processing section and second signal processing section included in an electronic tone generating apparatus which comprises: an electronic tone generator for generating tone signals of a first channel and second channel; a first speaker and second speaker for audibly reproducing tones corresponding to the tone signals of the first channel and second channel, respectively, generated by the electronic tone generator, a first microphone provided at a position corresponding to the first speaker; a second microphone provided at a position corresponding to the second speaker; the first signal processing section that performs predetermined signal processing on a picked-up sound signal generated by the first microphone picking up a sound and thereby outputs a processed picked-up sound signal; the second signal processing section that performs predetermined signal processing on a picked-up sound signal generated by the second microphone picking up a sound and thereby outputs a processed picked-up sound signal; a third speaker provided at a position corresponding to the first speaker, the third speaker audibly reproducing a sound corresponding to the processed picked-up sound signal output by the first signal processing section; and a fourth speaker provided at a position corresponding to the second speaker, the fourth speaker audibly reproducing a sound corresponding to the processed picked-up sound signal output by the second signal processing section. The method of the invention comprises: a step of, when an instruction for setting contents of signal processing is given, supplying a measuring sound signal to the third speaker and fourth speaker, and a step of setting contents of the signal processing to be performed by the first signal processing section on the basis of a picked-up sound signal generated by the first microphone during a predetermined measuring period when sounds corresponding to the measuring sound signal are being audibly reproduced by the third speaker and fourth speaker, and contents of the signal processing to be performed by the second signal processing section on the basis of a picked-up sound signal generated by the second microphone during the predetermined measuring period.

The present invention also provides a method for adjusting a signal processing characteristic of a signal processing section included in an electronic tone generating apparatus which comprises: an electronic tone generator for generating a tone signal; a main speaker for audibly reproducing a tone corresponding to the tone signal generated by the electronic tone generator; a microphone provided at a position corresponding to the main speaker; the signal processing section that performs predetermined signal processing on a picked-up sound signal generated by the microphone and thereby outputs a processed picked-up sound signal, the signal processing section including a first equalizer, FIR filter and second equalizer; and an auxiliary speaker for audibly reproducing a sound corresponding to the processed picked-up sound signal output by the signal processing section. The method of the invention comprises: a step of, when an instruction for setting contents of signal processing is given, performing a) adjustment processing in an open loop condition where the signal processing section is interrupted at a given interrupting point thereof and during a time period in which the auxiliary speaker is being caused to audibly reproduce a sound by receiving a measuring sound signal input via the interrupting point, the adjustment processing in the open loop condition measuring a frequency characteristic of a picked-up sound signal generated by the microphone and fed back to the interrupting point of the signal processing section, then correcting the measured frequency characteristic on the basis of a picked-up signal generated by the microphone while audible sound reproduction by the main speaker and auxiliary speaker is stopped, and then adjusting a characteristic of the first equalizer of the signal processing section so that a measured frequency characteristic of a sound signal after correction of the measured frequency characteristic by the setting section becomes a flat characteristic, and b) adjustment processing in a closed loop condition where a signal passage loop of the signal processing section is closed and during a time period in which the auxiliary speaker is being caused to audibly reproduce a sound by receiving the measuring sound signal input via the interrupting point, the adjustment processing in the closed loop condition measuring a frequency characteristic of a picked-up sound signal generated by the microphone, then correcting the measured frequency characteristic on the basis of a picked-up signal generated by the microphone while audible sound reproduction by the main speaker and auxiliary speaker is stopped, and then adjusting a characteristic of the second equalizer of the signal processing section so that a frequency characteristic of a picked-up sound signal generated by the microphone after correction of the measured frequency characteristic by the setting section becomes a flat characteristic.

The following will describe embodiments of the present invention, but it should be appreciated that the present invention is not limited to the described embodiments and various modifications of the invention are possible without departing from the basic principles of the invention. The scope of the present invention is therefore to be determined solely by the appended claims.

BRIEF DESCRIPTION OF THE DRAWINGS

For better understanding of the object and other features of the present invention, its preferred embodiments will be described hereinbelow in greater detail with reference to the accompanying drawings, in which.

DETAILED DESCRIPTION OF THE INVENTION

Figure 1:
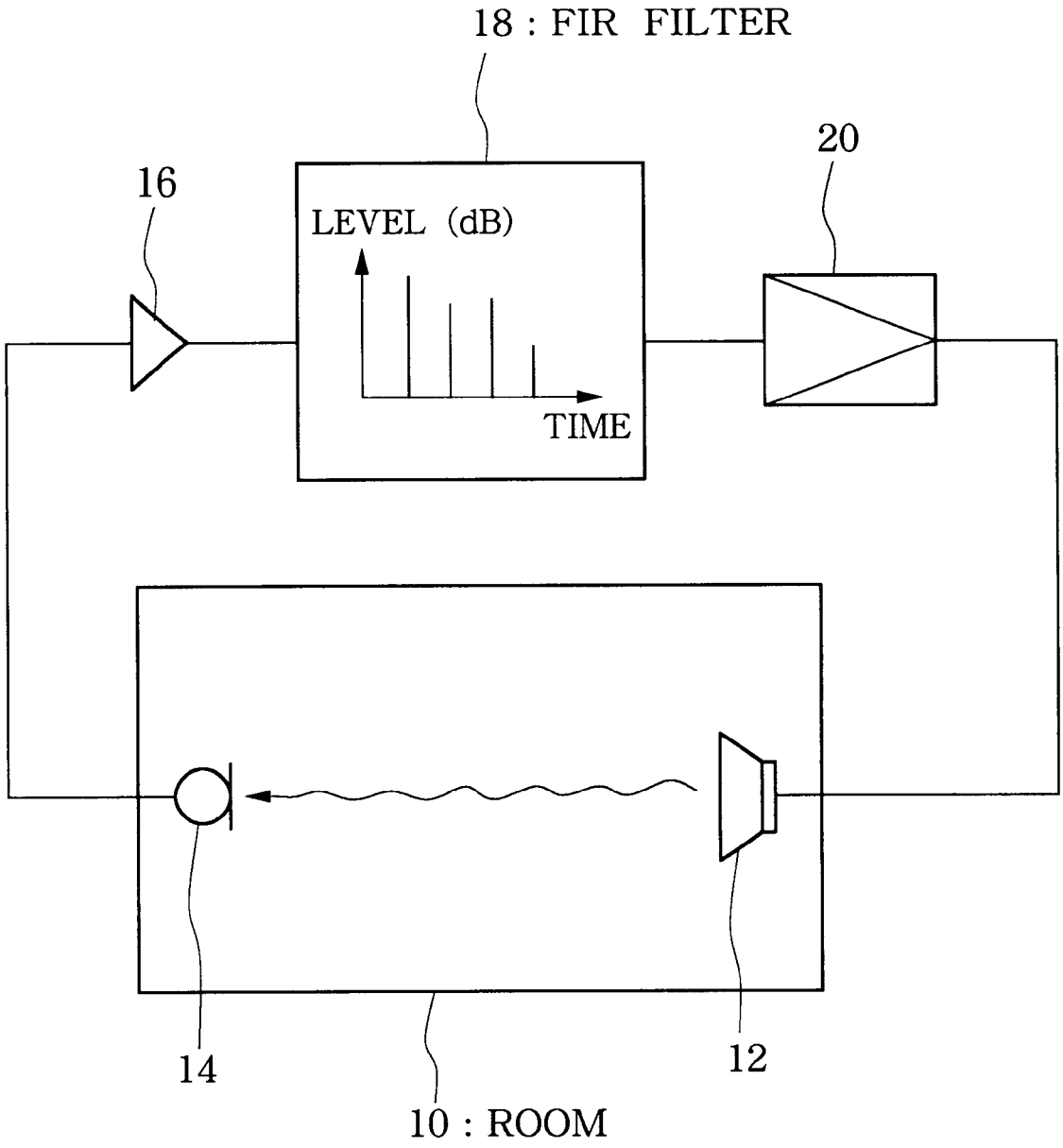
FIG. 1 is a diagram explanatory of the principles of acoustic feedback.
Figure 2:
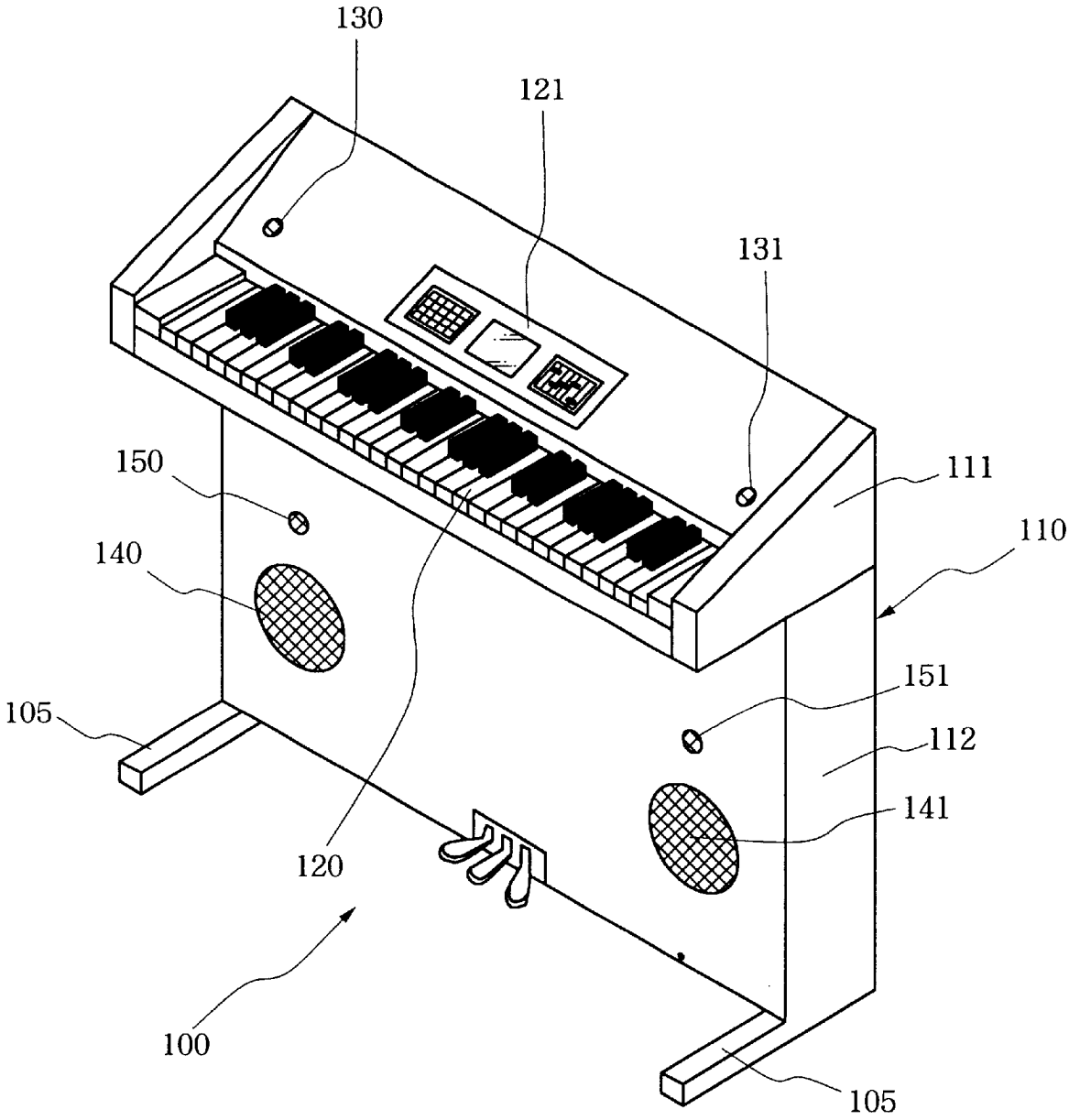
FIG. 2 is a perspective view showing an outer appearance of an electronic keyboard instrument in accordance with an embodiment of the present invention.
Figure 3:
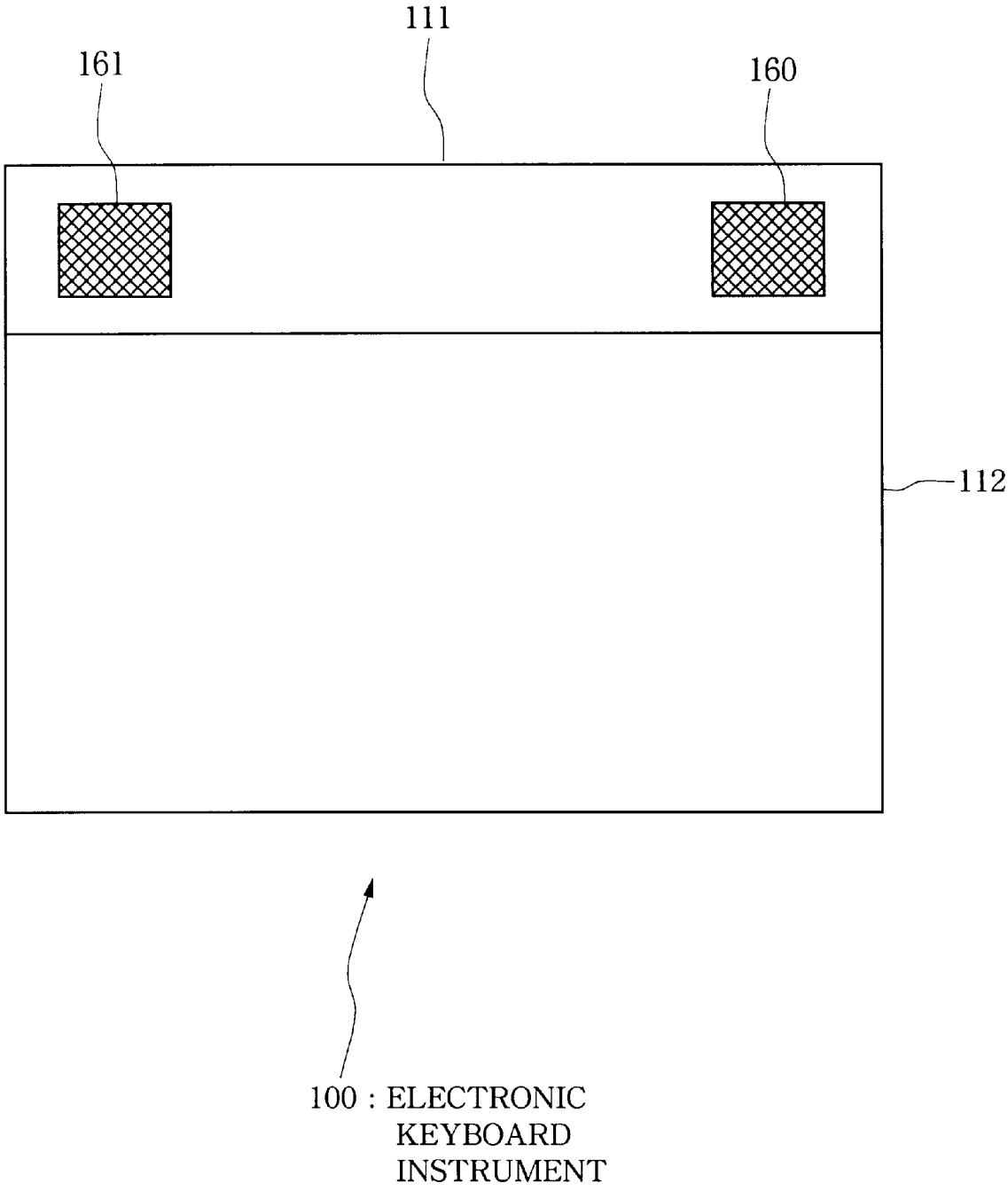
FIG. 3 is a rear view of the electronic keyboard instrument shown in FIG. 2.

1. External Construction of Electronic Keyboard Instrument:

FIGS. 2 and 3 are perspective and rear views, respectively, of an electronic keyboard instrument in accordance with an embodiment of the present invention. As seen in FIG. 2, the electronic keyboard instrument 100 includes foot portions 105, a casing 110 supported by the foot portions 105. Various components, such as an electronic tone generator, of the electronic keyboard instrument 100 are provided within the casing 110.

The casing 110 includes an upper casing portion 111 supporting thereon a keyboard 120, and a lower casing portion 112 disposed immediately below the upper casing portion 111. On a middle area of the upper casing portion 111 slightly above the keyboard 120, there is provided an operation panel 121 including an operating screen, switches, etc. Further, two microphones 130 and 131 are disposed at opposite end areas of the upper casing portion 111 which are located to the left and right of the operation panel 121 (i.e., low-pitch and high-pitch side areas of the keyboard 120).

Further, main speakers 140 and 141 are disposed on one surface 112*a*, facing a human player, of the lower casing portion 112 at left and right end (low-pitch side and high-pitch side) areas thereof, and microphones 150 and 151 are disposed adjacent to the main speakers 140 and 141, respectively. Further, as seen in FIG. 3, rear speakers 160 and 161 are disposed on the other surface 112*a*, opposite from the human player, of the lower casing portion 112 at low-pitch side end and high-pitch side areas thereof. Namely, the electronic keyboard instrument 100 includes the main speaker 140 (for a left (L) channel), microphone 150 and rear speaker 150 (for the L channel) on its low-pitch side areas, and the main speaker 141 (for a right (R) channel), microphone 151 and rear speaker 161 (for the R channel) on its high-pitch side areas.

Figure 4:
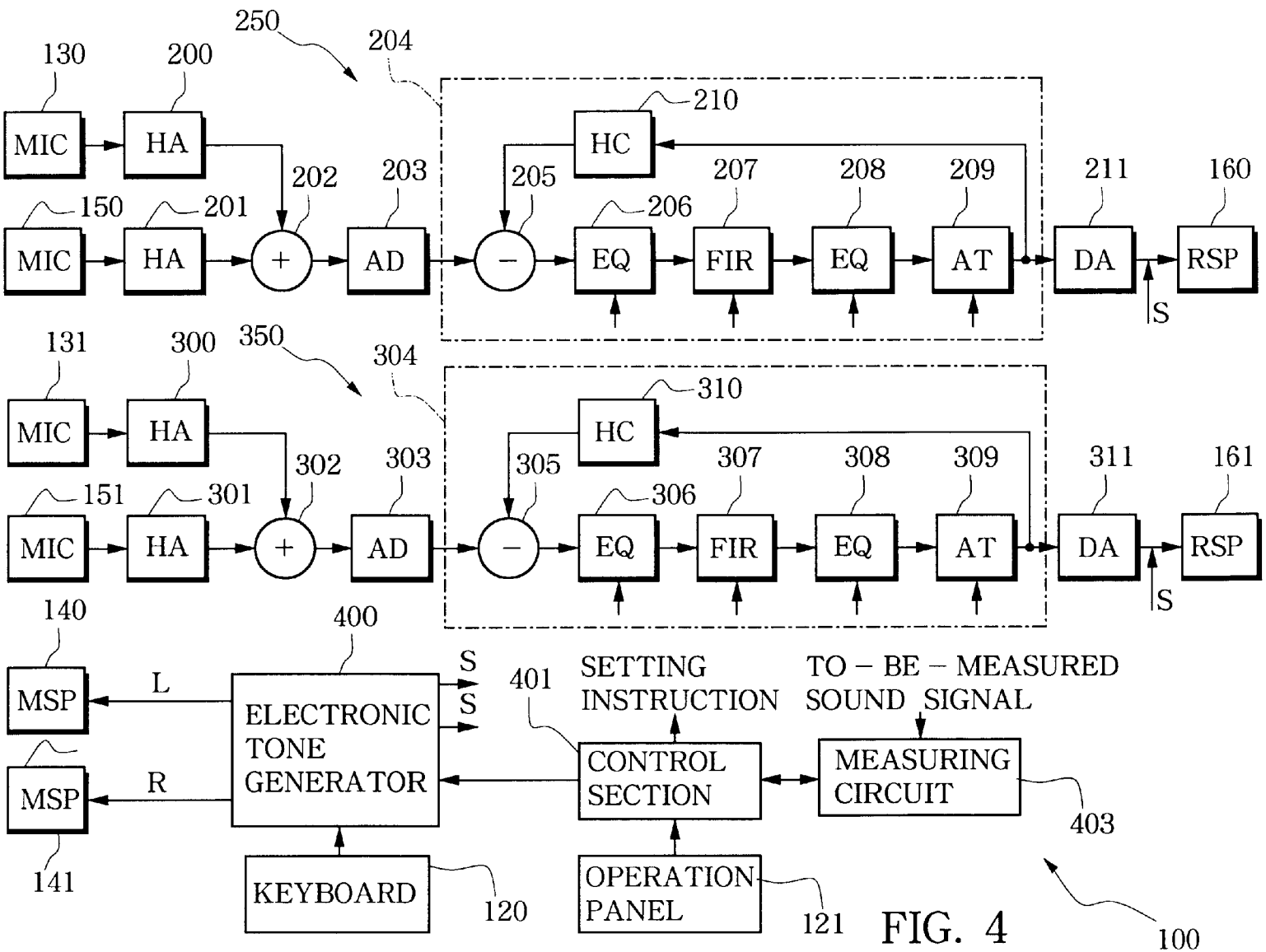
FIG. 4 is a block diagram showing a general setup of the electronic keyboard instrument of FIG. 2.

2. Electric Construction of the Electronic Keyboard Instrument:

FIG. 4 is a block diagram showing a general electric construction of the electronic keyboard instrument 100. The electronic keyboard instrument 100 generally comprises an L-channel AFC (Active Field Control) circuit 250, an R-channel AFC circuit block 350, an electronic tone generator 400, and a measuring circuit 403.

The electronic tone generator 400 generates tone signals in response to performing operation, by the human player, on the keyboard 120. More specifically, the electronic tone generator 400 generates tone signals L and R of the L (left) and R (right) channels on the basis of performing operation information supplied from a key depression sensor unit (not shown) etc. that detects each performing operation, by the human player, on the keyboard 120. The main speakers 140 and 141 sound or audibly reproduce tones corresponding to the tone signals L and R of the L and R channels generated by the electronic tone generator 400. Note that whereas the electronic tone generator 400 in the instant embodiment is designed to permit stereo tone reproduction through the main speakers 140 and 141 by supplying the generated tone signals L and R to the respective speakers 140 and 141, the tone generator 400 may supply a same tone signal to both of the main speakers 140 and 141 for monaural tone reproduction. Namely, similarly to ordinary electronic pianos, the electronic keyboard instrument 100 has a function of generating piano tones corresponding to performing operation on the keyboard 120. Further, the electronic tone generator 400 supplies measuring tone signals S to the L-channel AFC circuit block 250 and R-channel AFC circuit block 350 in response to an instruction given from a control section 401, as will be later described in detail.

The measuring circuit 403, which comprises an FFT (Fast Fourier Transform) analyzer or a real-time analyzer having a 1/N band-pass filter, etc., measures frequency characteristics of each supplied signal to be measured (to-be-measured sound signals) and outputs the measured results to the control section 401 as will be later described.

The control section 401 comprises a CPU (Central processing Unit), a ROM (Read-Only Memory) and a RAM (Random Access memory), etc., which controls various components of the electronic keyboard instrument 100 by executing programs prestored in the ROM. The electronic keyboard instrument 100 in accordance with the instant embodiment is characterized primarily by AFC (Active Field Control) contents adjustment processing that is carried out under the control of the control section 401, as will also be later described in detail.

The L-channel AFC circuit block 250 (i.e., first signal processing section) executes signal processing, such as impartment, of reflected sound components, to sound signals generated by the microphones 130 and 150 picking up sounds (hereinafter, the thus-generated sound signals are also referred to as "picked-up sound signals" or "picked-up tone signals"). Signals having been subjected to such signal processing by the L-channel AFC circuit block 250 are supplied to the rear speaker 160 for audible reproduction. Namely, the L-channel AFC circuit block 250 carries out a reverberation impartment process utilizing acoustic conditions of the space where the electronic keyboard instrument 100 is installed, and other processes. More specifically, to carry out the signal processing, the L-channel AFC circuit block 250 includes head amplifiers 200 and 201, an adder 202, an A/D (Analog-to-Digital) converter 203, an L-channel signal processing section 204, and a D/A (Digital-to-Analog) converter 211.

The head amplifiers 200 and 201 adjust the gains of the picked-up sound signals generated by the corresponding microphones 130 and 150, and then supply the resultant gain-adjusted picked-up sound signals to the adder 202. When performance tones corresponding to human player's operation on the keyboard 120 are being sounded via the main speakers 140 and 141, sounds including the performance tones are picked up by the microphones 130 and 150 disposed in the low-pitch side areas and then the picked-up sound signals thus generated by the microphones 130 and 150 are supplied to the L-channel AFC circuit block 250, where they are subjected to later-described processing. The picked-up sound signals thus processed by the L-channel AFC circuit block 250 (i.e., processed picked-up sound signals) are each audibly reproduced via the rear speaker 160.

Specifically, the adder 202 adds together the picked-up sound signals generated by the microphones 130 and 150, and the resultant added sound signal is supplied from the adder 202 to the L-channel signal processing section 204. The L-channel signal processing section 204 includes a subtracter 205, a programmable equalizer (EQ) 206, an FIR filter 207, a programmable equalizer (EQ) 208, an attenuator (AT) 209, and a howling canceler (HC) 210. The L-channel signal processing section 204 may be implemented by a DSP (Digital Signal Processor).

Figure 5:
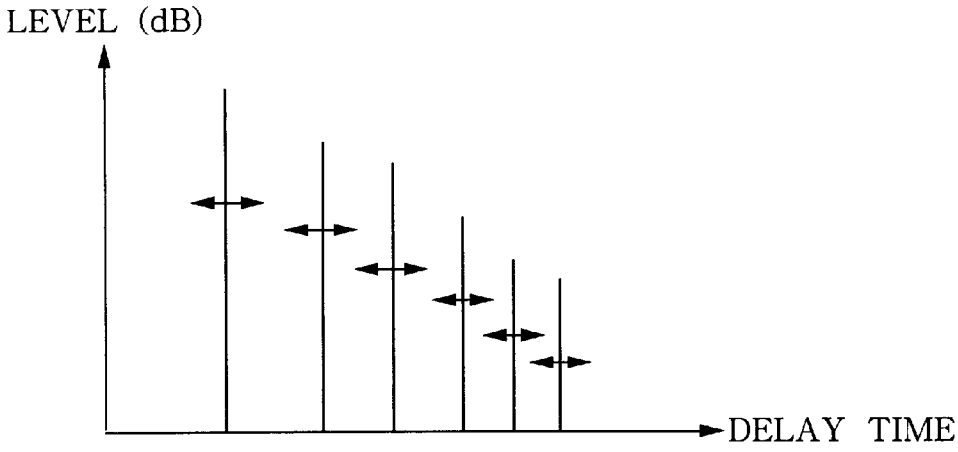
FIG. 5 is a diagram explanatory of time-axial variation of an FIR filter employed in the electronic keyboard instrument of FIG. 2.

The L-channel signal processing section 204 arranged in the above-described manner carries out the following operations. First, the picked-up sound signal supplied from the adder 202 is subjected to frequency characteristic correction by the preceding-stage programmable equalizer 206. Then, an initial reflected sound signal is generated by the FIR filter 207 on the basis of the sound signal adjusted by the programmable equalizer 206, the thus-generated initial reflected sound signal is subjected to frequency characteristic correction by the succeeding-stage programmable equalizer 208, and the gain of the thus-corrected initial reflected sound signal is adjusted by the attenuator 209. Here, parameters of the FIR filter 207 are varied successively on the time axis in a random fashion, as illustrated in FIG. 5, so that frequency characteristics of the FIR filter 207 are averaged to thereby reduce coloration and increase a howling margin. The time-axial variations of the parameters of the FIR filter 207 are implemented, for example, by independently moving an output tap of the FIR filter 207 within a variation width of 0.25–5 msec. Output of the attenuator 209 is supplied, via a volume control, muting circuit, amplifier unit, etc., to the rear speaker 160 for audible reproduction. Note that, in the instant embodiment, the user is allowed to instruct, via the operation panel 121, contents of a reverberation pattern to be imparted or ON/OFF state of reverberation impartment, and the control section 401 controls a reverberation pattern, to be produced by the FIR filter 207, in accordance with the user instruction. More specifically, the control section 401 reads out a filter coefficient corresponding to one of a plurality of reverberation patterns stored in the ROM in accordance with the user instruction, and sets the thus read-out filter coefficient in the FIR filter 207. Further, characteristics of the programmable equalizers 206 and 208 and contents of the gain adjustment to be made by the attenuator 209 are determined by AFC contents adjustment processing that is carried out under the control of the control section 401 in response to an automatic adjustment instruction from the user, as will be later described in detail.

The howling canceler 210 of the L-channel signal processing section 204 functions to prevent undesired howling that tends to be caused by a sound, audibly reproduced on the basis of the sound signal processed by the processing section 204, being fed back directly to the microphones 130 and 150. For this purpose, the howling canceler 210 feeds the processed picked-up sound signal back to the subtracter 205 at the same timing the processed picked-up sound signal is to be reproduced, so as to cancel out the signals fed from the rear speakers 160 and 161 directly back to the microphones 130 and 150.

The R-channel AFC circuit block 350 (i.e., second signal processing section) executes signal processing, such as impartment, of reflected sound components, to picked-up sound signals generated by the microphones 131 and 151. Picked-up signals having been subjected to such signal processing (processed picked-up sound signals) are each supplied to the rear speaker 161 for audible reproduction. Namely, the R-channel AFC circuit block 350 carries out a reverberation impartment process utilizing acoustic conditions of the space where the electronic keyboard instrument 100 is installed, and other processes. More specifically, to carry out the signal processing, the R-channel AFC circuit block 350 includes head amplifiers 300 and 301, an adder 302, an A/D converter 303, R-channel signal processing section 304, and a D/A converter 311.

The head amplifiers 300 and 301 adjust the gains of the picked-up sound signals generated by the corresponding microphones 131 and 151, and then supply the resultant gain-adjusted sound signals to the adder 302. When performance tones corresponding to human player's operation on the keyboard 120 are being sounded via the main speakers 140 and 141, sounds including the performance tones are picked up by the microphones 131 and 151 disposed in the high-pitch side areas and then supplied to the R-channel AFC circuit block 350, where they are subjected to the reflected-sound-component impartment process etc. Picked-up sound signal thus processed by the R-channel AFC circuit block 350 is audibly reproduced via the rear speaker 161.

The adder 302 adds together the picked-up sound signals generated by the microphones 131 and 151, and the resultant added sound signal is supplied from the adder 302 to the R-channel signal processing section 304. Similarly to the L-channel signal processing section 204, the R-channel signal processing section 304 includes a subtracter 305, a programmable equalizer (EQ) 306, an FIR filter 307, a programmable equalizer (EQ) 308, an attenuator (AT) 309, and a howling canceler (HC) 310. The R-channel signal processing section 304 may be implemented by a DSP (Digital Signal Processor).

The R-channel signal processing section 304 carries out operations similar to those carried out by the L-channel signal processing section 204, and thus the operations carried out by the R-channel signal processing section 304 will not be described here to avoid unnecessary duplication. As with the L-channel signal processing section 204, the user is allowed to instruct, via the operation panel 21, contents of a reverberation pattern to be imparted or ON/OFF state of reverberation impartment, and characteristics of the FIR filter 307 are set in accordance with the user instruction. Further, characteristics of the programmable equalizers 306 and 307 and contents of the gain adjustment to be made by the attenuator 309 are determined by the AFC contents adjustment processing that is carried out under the control of the control section 401 in response to an automatic adjustment instruction from the user. The following paragraphs describe details of the AFC contents adjustment processing performed in the electronic keyboard instrument 100.

3. AFC Contents Adjustment Processing:

As noted above, the AFC (Active Field Control) contents adjustment processing is carried out by setting signal processing characteristics of the various components, such as characteristics of the programmable equalizers of the L-channel and R-channel signal processing sections 204 and 304 and amounts of gain adjustment by the attenuators of the signal processing sections 204 and 304. Upon receipt, via the operation panel 121, of a user's instruction for executing AFC contents adjustment, the control section 401 carries out the AFC contents adjustment processing in accordance with a step sequence flow charted in FIG. 6. In case the user has erroneously operated the keyboard 120 after receipt of the user's AFC contents adjustment instruction, the control section 401 performs control to inhibit the electronic tone generator 400 from generating a tone signal in response to the user's erroneous keyboard operation, so as to allow the AFC contents adjustment processing to be carried out smoothly.

First, at step S1, the control section 401 controls various components of the electronic keyboard instrument 100 to measure frequency characteristics of picked-up sound signals generated by the microphones 130, 131, 150, 151 picking up sounds in an open loop condition. Namely, the control section 401 turns off given switches (not shown) etc. to break or interrupt signal paths of FIG. 4, for example, between the attenuator 209 and the D/A converter 211 or the programmable equalizer 208 (or between the FIR filter 207 and the programmable equalizer 208) and between the attenuator 309 and the D/A converter 311 or the programmable equalizer 308 (or between the FIR filter 307 and the programmable equalizer 308), and it places, in an open loop condition, each of the signal passageway loops including the L-channel and R-channel AFC circuit blocks 250 and 350 (namely, signal paths between the individual components and signal transmission paths in the installation space between the speakers and the microphones).

After having established such an open loop condition, the control section 401 instructs the electronic tone generator 400 to output measuring tone signals S over a predetermined measuring period. Specifically, the electronic tone generator 400 receives such measuring tone signals S via a point of the signal passageway of the L-channel AFC circuit block 250 following the interrupting point (e.g., a point immediately preceding the rear speaker 160) and via a point of the signal passageway of the R-channel AFC circuit block 350 following the interrupting point (e.g., a point immediately preceding the rear speaker 161). As a consequence, tones (stereo tones) corresponding to the received measuring tone signals S are sounded via the L-channel rear speaker 160 and R-channel rear speaker 161 over the predetermined measuring period.

Although signals of relatively flat frequency characteristics, such as pink noise or white noise, may be used as the measuring tone signals S, pink noise sounded via the speakers can not be said to be comfortable to human listeners. Thus, the instant embodiment uses measuring tone signals S that will sounded as one or more predetermined chords; namely, the predetermined chords are sounded via the rear speakers 160 and 161 over the predetermined measuring period, so that an uncomfortable feeling given to the human listeners can be minimized during the measuring period The user of the predetermined chords as measuring tones in the instant embodiment as noted above is not only for the purpose of minimizing the uncomfortable feeling given to human listeners, but also for the following reason. Namely, if only a single tone of a given pitch is sounded, then the single tone, having many components of frequency bands of its fundamental and harmonic components alone, i.e. having biased frequency characteristics, becomes an object to be measured, which will unavoidably hinder accurate AFC contents adjustment. If, on the other hand, chords are used as the measuring tones as in the instant embodiment, fundamental and harmonic components of individual chord-constituent tones become objects to be measured, in which case frequency characteristics of the measuring tones become relatively flat and thus the accuracy of the AFC contents adjustment using measured results of the measuring tones can be enhanced to a significant degree. Further, a sequence of chords may be caused to progress over time so that tones can be sounded at pitches over a wide frequency band and the user can be prevented from having an uncomfortable feeling during the measurement. Namely, it is preferable that the measuring tones have considerably uniform spectra over as wide a frequency band as possible, and it is more preferable that the measuring tones have spectra covering an almost entire range of tone pitches capable of being sounded by the electronic keyboard instrument equipped with the measuring function. It is therefore preferable that the described embodiment of the electronic keyboard instrument use measuring tones having frequency components covering an almost entire range of tone pitches (e.g., tone pitches of 88 keys) that can be sounded by the electronic piano function. If signals for performing a music piece having such a wide pitch range are used as the measuring tone signals, the user can wait for measured results while listening to a performance of the music piece, in which case the measurement can be performed in conditions more comfortable to the user than where a single tone is being merely sounded monotonously.

Further, in the instant embodiment of the present invention, the measuring tones are preferably sounded such that chord-constituent tones are first sounded at relatively high pitches, then progressively lowered in pitch and then again raised to relatively high pitches. This is for the purpose of obtaining measured results that can contribute to more accurate AFC contents adjustment, because higher-pitch tones are greater in energy than lower-pitch tones and thus initiating sounding of the measuring tones with a high-pitch tone can speed up a rise of energy of the measuring tones. Note that the measuring tones are not limited to chord-constituent tones; they may be tones having frequency components covering a wide frequency band or tones of a music piece.

In the instant embodiment, the electronic tone generator 400 outputs tone signals for sounding chords, as set forth above, to the L-channel rear speaker 160 and R-channel rear speaker 161, and, at the time of stereo tone reproduction corresponding to these tone signals, measurement is made of frequency characteristics etc. of picked-up sound signals generated by the microphones 130, 131, 150, 151 picking up the stereophonically-reproduced tones. Namely, the stereophonically-reproduced measuring sounds are picked up by the microphones 130 and 150 of the L-channel AFC circuit block 250 and microphones 131 and 151 of the R-channel AFC circuit block 350. Then, measured results, such as frequency characteristics, of the picked-up sound signals generated by the microphones 130 and 150 (hereinafter referred to as measured results SOL) are used to set the programmable equalizer 209 etc. of the L-channel AFC circuit block 250, while measured results of the picked-up sound signals generated by the microphones 131 and 151 (hereinafter referred to as measured results SOR) are used to set the programmable equalizer 309 etc. of the R-channel AFC circuit block 350.

More specifically, the picked-up sound signals of the stereophonically-reproduced measuring sounds, generated by the microphones 130 and 150, are passed via the head amplifiers 200 and 201 to the adder 202, and the added result of the adder 202 is converted via the A/D converter 203 into a digital signal and then supplied to the L-channel signal processing section 204. In the L-channel signal processing section 204, the signal is delivered through the programmable equalizer 206 to the FIR filter 207 to generate a reverberation signal. The control section 401 performs switching control of the not-shown switches etc., so that a signal obtained by passing the reverberation signal through the programmable equalizer 208 and attenuator 209 (or output from the programmable equalizer 208 or attenuator 209) is supplied by the control section 401 to the measuring circuit 403 as a to-be-measured sound signal. Once the measuring tone signal is thus supplied to the measuring circuit 403, the measuring circuit 403 measures the frequency characteristics and gain of the supplied to-be-measured sound signal. Namely, measurement is made of transmission characteristics of the signal, including transmission characteristics of the interior space of the room, and gain of the signal when the signal passageway of the L-channel AFC circuit block 250 is placed in an open loop condition, and the measured results are supplied to the control section 401 and then stored in the RAM or the like.

This and following paragraphs give a detailed description about a manner in which the transmission characteristics are measured in the open loop condition. In the instant embodiment, once the user instructs automatic AFC contents adjustment, the characteristics of the programmable equalizers 206 and 208 are adjusted to be flat by the control section 401, the gain of the attenuator 209 is set to 0 dB, and the volume control (not shown) provided immediately following the attenuator 209 is set to its maximum value. Further, switches provided at the above-mentioned interrupting points of the signal passageways are turned off to interrupt the loops, and measuring tone signals generated by the electronic tone generator 400 are introduced into the signal passageways. These measuring tone signals are audibly reproduced via a speaker system 72 and transmitted in the space of the room to be picked up by a microphone unit 78. The resultant picked-up signals output from the microphone unit are passed to the measuring circuit 403, including the FFT analyzer etc., where their frequency characteristics are measured.

Figure 7A:
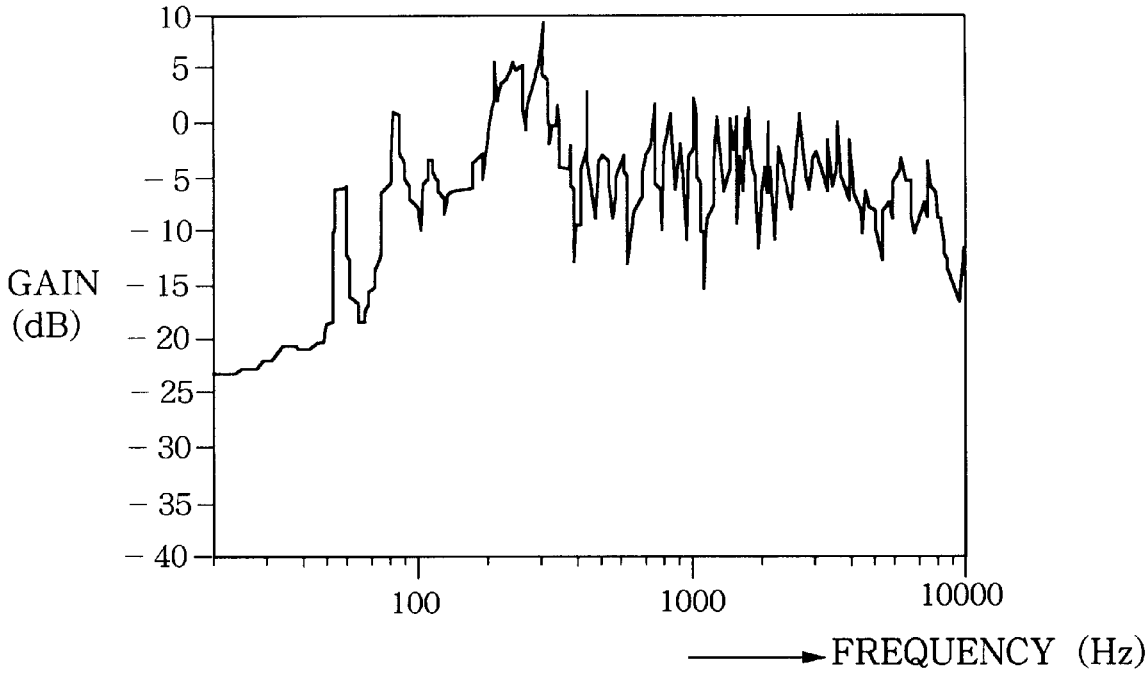
FIGS. 7A and 7B are diagrams illustrating frequency characteristics of a signal measured by the AFC contents adjustment processing.
Figure 7B:
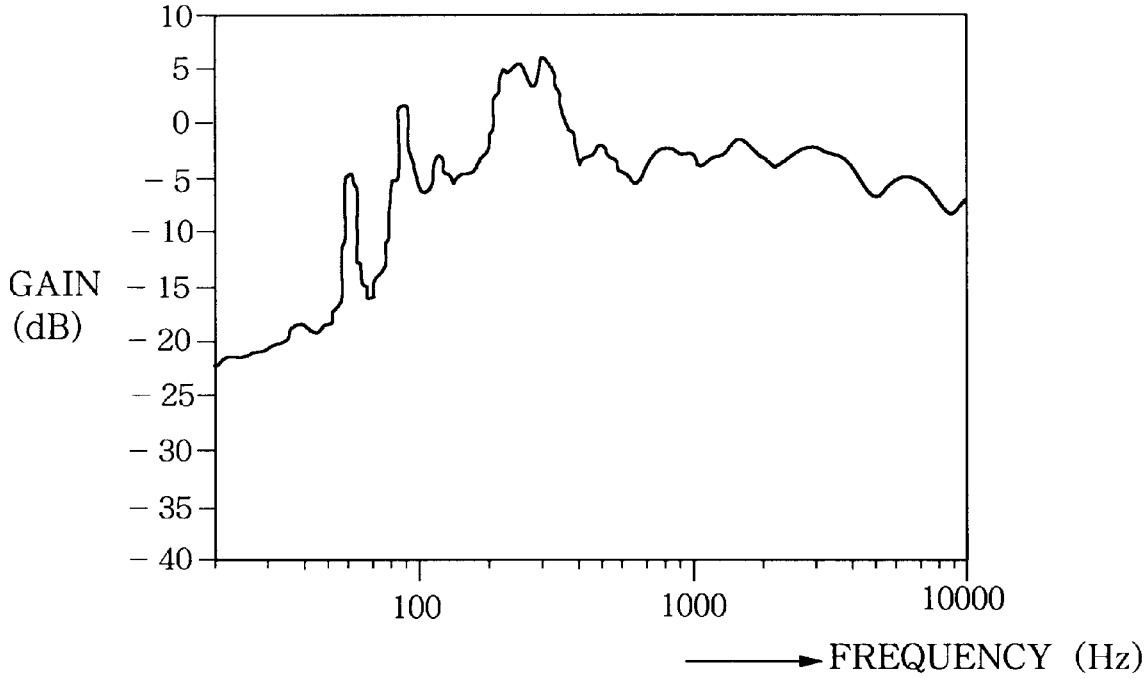

After having measured the frequency characteristics, the measuring circuit 403 carries out a smoothing process. Results of the measurement by the measuring circuit 403 are illustratively shown in FIG. 7A, and the smoothing process is carried out, in a manner as shown in FIG. 7B, in order to facilitate processing executed by the control section 401 using the measurement results. The smoothing process is performed by, for example, averaging ±10 points of every data having undergone an FFT (Fast Fourier Transform) process. Because the data having the undergone FFT process have linear frequency widths, if they are viewed on a logarithmic axis, the smoothing process is performed with no average taken for a low frequency band (lower than 100 Hz), the number of points to be average progressively increased for a medium frequency band (100 Hz–1 kHz), and ±10 points of every data averaged for a high frequency band (higher than 1 kHz). Note that "±10 points of every data averaged" means 10 data preceding each FFT-processed data and 10 data following that FFT-processed data are averaged. For example, if original data of each FFT-processed data is represented by "f(x)" and data after having undergone the averaging operation is represented by "F(x)", averaged FFT-processed data F(x) can be determined by the following equation:

$$F(x) = \frac{1}{10}\sum_{n=x-10}^{x+10} f(n) \quad \text{[EQUATION 1]}$$

Performing the equation for all of the FFT data f(x) can calculate the same number of FFT-processed data F(x) as the original data f(x). In this way, the frequency characteristics can be measured in the instant embodiment.

Further, the sound signals of the stereophonically-reproduced measuring sounds, generated by the microphones 131 and 151 of the R-channel AFC contents circuit 350, are passed via the head amplifiers 300 and 301 to the adder 302, and the added result of the adder 302 is converted via the A/D converter 303 into a digital signal and then supplied to the R-channel signal processing section 304. In the R-channel signal processing section 304, the signal is delivered through the programmable equalizer 306 to the FIR filter 307 to generate a reverberation signal. The control section 401 performs switching control of the not-shown switches etc., so that a signal obtained by passing the reverberation signal through the programmable equalizer 308 and attenuator 309 (or output from the programmable equalizer 308 or attenuator 309) is supplied by the control section 401 to the measuring circuit 403 as a to-be-measured sound signal. Once the to-be-measured sound signal is thus supplied to the measuring circuit 403, the measuring circuit 403 measures the frequency characteristics and gain of the supplied to-be-measured sound signal. Namely, measurement is made of the transmission characteristics of the signal, including transmission characteristics of the space in the room, and gain of the signal when the signal passageway of the R-channel AFC circuit block 350 is placed in the open loop condition, and the measured results are supplied to the control section 401 and then stored in the RAM or the like. Manner of performing the measurement for the R-channel signal processing section 304 is generally the same as described above for the L-channel signal processing section 204, and thus will not be described here to avoid unnecessary duplication.

Once the control section 401 has obtained the measured results, such as the transmission characteristics of the signal passage loops including the L-channel AFC contents circuit 250 and R-channel AFC contents circuit 350, it performs a process for measuring background noise (such as air conditioning noise in the room) while maintaining the open loop condition, at step S2. Namely, the control section 401 terminates the output of the measuring tone signals S by the electronic tone generator 400 so that the microphones 130, 131, 150, 151 pick up only background noise present in the interior space of the room while no electronic tone is being generated at all, and the control section 401 measures the frequency characteristics etc. of the picked-up sound signals generated by the microphones 130, 131, 150, 151 on the basis of the measuring tone signals S.

More specifically, the picked-up sound signals generated by the microphones 130 and 150 of the L-channel AFC contents circuit 250 are supplied, via the same signal path as used at the time of the above measurement, to the measuring circuit 403 as to-be-measured sound signals, so that the frequency characteristics and gain of each of the supplied to-be-measured sound signals are measured by the measuring circuit 403. Namely, measurement is made of the transmission characteristics, including the transmission characteristics of the interior space of the room and gain of the signal when the signal passageway of the L-channel AFC circuit block 250 is placed in the open loop condition and the electronic keyboard instrument 100 is generating no tone at all, and the resultant measured results for the L channel (hereinafter referred to as "measured results SBGL") are supplied to the control section 401 and then stored in the RAM or the like. The same measurement is made for the R-channel AFC circuit block 350 as well, and the resultant measured results for the right channel (hereinafter referred to as "measured results SBGR") are supplied to the control section 401 and then stored in the RAM or the like. Manner of performing the measurement is generally the same as described above, and thus will not be described here to avoid unnecessary duplication.

Once the control section 401 has acquired, for both of the L-channel AFC contents circuit 250 and R-channel AFC circuit block 350, the measured results SOL and SOR when measuring sounds were generated in the open loop condition and the measured results SBGL and SBGR when no measuring sound was generated, it corrects the measured results SOL and SOR on the basis of the measured results SBGL and SBGR, at step S3.

More specifically, if a difference calculated by subtracting the measured result SGBL(dB) from the measured result SOL(dB), i.e. S/N ratio, is equal to or greater than 3 dB but smaller than 10 dB for each predetermined frequency, then the measured result SOL of the L-channel AFC contents circuit 250 is corrected using the following equation, to derive a corrected measured result HSOL.

$$HSOL = 10\log_{10}\left(10^{\frac{SOL}{10}} - 10^{\frac{SBGL}{10}}\right) \quad \text{[EQUATION 2]}$$

For frequencies at which the S/N ratio is equal to or greater than 10 dB, the instant embodiment does not correct the measured result SOL. because it is considered that the background noise has little influence at these frequencies. Also, for frequencies at which the S/N ratio is below 3 dB, the instant embodiment excludes the measured result SOL at each of these frequencies from a group of the measured results SOL to be corrected, because it is considered that such a measured result SOL is almost entirely due to the background noise.

Similarly, if a difference calculated by subtracting the measured result SGBR(dB) from the measured result SOR (dB), i.e. S/N ratio, is equal to or greater than 3 dB but smaller than 10 dB, then the measured result SOR of the R-channel AFC contents circuit 350 is corrected using the following equation, to derive a corrected measured result HSOR.

$$HSOR = 10\log_{10}\left(10^{\frac{SOR}{10}} - 10^{\frac{SBGR}{10}}\right) \quad \text{[EQUATION 3]}$$

For frequencies at which the S/N ratio is equal to or greater than 10 dB, the instant embodiment does not correct the measured result SOR. because it is considered that the background noise has little influence at these frequencies. Also, for frequencies at which the S/N ratio is below 3 dB, the instant embodiment excludes the measured result SOR at each of these frequencies from a group of the measured results SOR to be corrected, because it is considered that such a measured result SOR is almost entirely due to the background noise.

By making such corrections, it is possible acquire corrected measured results HSOL and HSOR by removing most of the influences of the background noise from the measured results SOL and SOR. These corrected measured results HSOL and HSOR can be used in the adjustment processing to be later described. Note that experiments conducted by the inventor of the present invention have confirmed that background noise greatly influences low-frequency regions of the measured results and that the above-described corrections can acquire corrected measured results HSOL and HSOR having little influence of background noise.

Upon acquisition of the corrected measured results HSOL and HSOR with the influences of the background noise appropriately corrected, the control section 401 sets, on the basis of the respective measured results, characteristics of the programmable equalizer 208 and gain adjustment amount of the attenuator 209 following the L-channel AFC circuit block 250 and characteristics of the programmable equalizer 308 and gain adjustment amount of the attenuator 309 following the R-channel AFC circuit block 350, at step S4.

Namely, on the basis of the corrected measured result HSOL, the control section 401 adjusts the characteristics of the programmable equalizer 208 so that the frequency characteristics, representing the measured result, will be flattened within a howling-preventing level range when the same measurement is performed in the open loop condition while measuring sounds are being generated. For example, a per-frequency characteristic PAL(dB) of the programmable equalizer 208 can be determined as a value satisfying the following equation on the basis of the corrected measured result SOL(dB) and predetermined reference characteristic R(dB):

$$(\mathrm{HOSL}-R)-\mathrm{PAL}=-15\ \mathrm{dB}$$

Figures 8, 9:
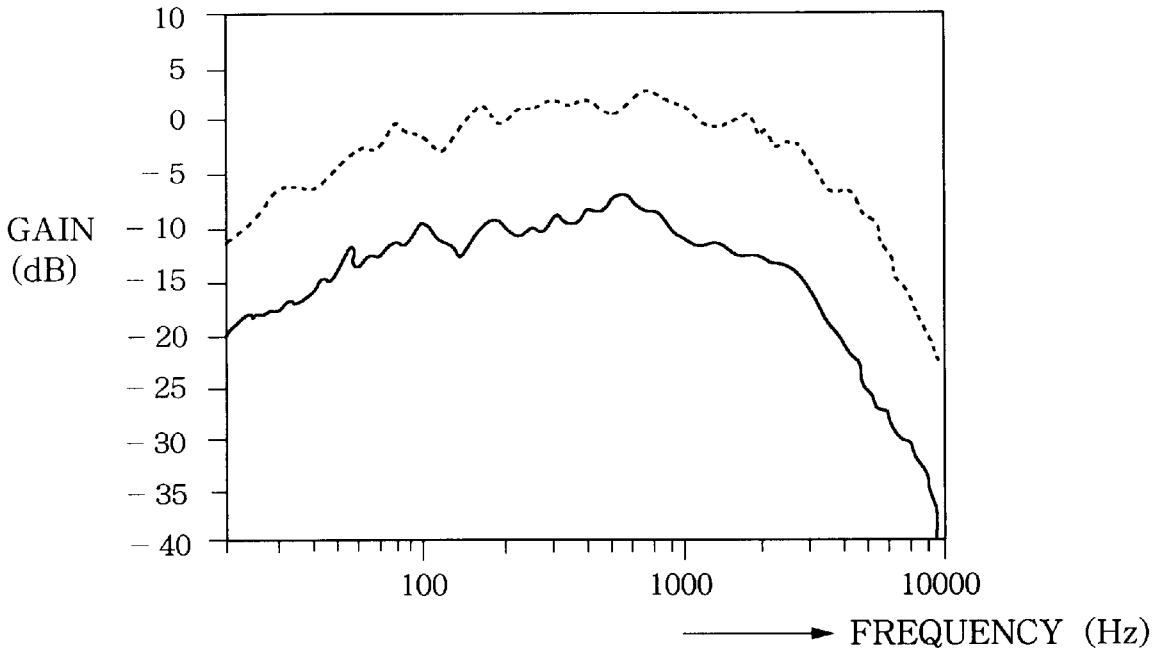
FIG. 8 is a diagram illustrating frequency characteristics measured by the AFC contents adjustment processing, which particularly shows frequency characteristics of a programmable equalizer employed in the electronic keyboard instrument.
FIG. 9 is a diagram explanatory of contents of a table stored in a ROM of a control section in a modification of the electronic keyboard instrument.

Here, the reference characteristic R is a frequency characteristic obtainable by subjecting a measuring tone signal S to the FFT (Fast Fourier Transform) process. Where corrected measured results SOL have been obtained as denoted by a solid line in FIG. 8, there can be obtained a characteristic PAL of the programmable equalizer 208 as denoted by broken lines in FIG. 8. Note that "−15 dB" is a predetermined value intended to prevent undesired howling, and the reference characteristic R and predetermined value "−15 dB" are prestored in the ROM of the control section 401.

Then, the control section 401 outputs setting instructions such that the programmable equalizer 208 is set to the characteristic PAL having been determined in the above-described manner. For example, where the programmable equalizer 208 is a parametric equalizer having a settable center frequency, gain and selectivity Q, the control section 401 outputs setting instructions indicative of a particular center frequency, gain and selectivity Q such that the programmable equalizer 208 can be set to the determined characteristic PAL.

The characteristic of the programmable equalizer 208 in the L-channel AFC circuit block 250 is adjusted in the above-described manner. The characteristic of the programmable equalizer 209 in the R-channel AFC circuit block 350 is adjusted in generally the same manner using the corrected measured results HSOR.

After completion of the characteristic correction of the programmable equalizers 208 and 308, the control section 401 proceeds to adjust the attenuator 209 of the L-channel AFC circuit block 250 and attenuator 309 of the R-channel AFC circuit block 350. The above-described characteristic correction of the programmable equalizer 208 should have set the gain in the open loop condition to an appropriate level that could prevent howling; however, the programmable equalizer 208 can sometimes not be set to the target characteristic PAL in the case where a great many IIR (Infinite Impulse Response)-type equalizers are used as the programmable equalizer 208. Thus, after having set the programmable equalizer 208 in the above-described manner, the control section 401 causes the electronic tone generator 400 to again generate a measuring tone signal S for sounding a measuring tone, so that frequency characteristics of picked-up sound signals then generated by the microphones 130 and 150 (i.e., sound signal passed through the equalizer 208) are measured by the measuring circuit 403. After that, the control section 401 adjusts the attenuator 209, on the basis of the measured results, in such a manner that the peak value does not exceed a predetermined howling level (i.e., a level beyond which undesirable howling may be caused). The control section 401 adjusts the attenuator 309 of the R-channel AFC circuit block 350 in generally the same manner as in the adjustment of the attenuator 209 of the L-channel AFC circuit block 250.

After the aforementioned adjustment of the programmable equalizers 208 and 308 and attenuators 209 and 309 has been completed, the control section 401 controls the various components of the electronic keyboard instrument 100 to measure frequency characteristics of picked-up sound signals generated by the microphones 130, 131, 150, 151 in a closed loop condition. Namely, the control section 401 turns on the not-shown switches etc. to establish connections in the predetermined signal paths of FIG. 4, for example, between the attenuator 209 and the D/A converter 211 or the programmable equalizer 208 (or between the FIR filter 207 and the programmable equalizer 208) and between the attenuator 309 and the D/A converter 311 or the programmable equalizer 308 (or between the FIR filter 307 and the programmable equalizer 308) which were interrupted during the above-described measurement in the open loop condition, and it places, in a closed loop condition, each of the signal passage loops including the L-channel and R-channel AFC circuit blocks 250 and 350.

Once the closed loop condition has been established, the control section 401 instructs the electronic tone generator 400 to output measuring tone signals S over a predetermined measuring period, as in the measurement in the open loop condition (see step S1 above). Specifically, the electronic tone generator 400 receives such measuring tone signals S via a desired point of the signal passageway of the L-channel AFC circuit block 250 and via a desired point of the signal passageway of the R-channel AFC circuit block 350. As a consequence, tones (stereo tones) corresponding to the received measuring tone signals S are sounded or audibly reproduced via the L-channel rear speaker 160 and R-channel rear speaker 161 over the predetermined measuring period.

In this closed loop condition, measurement is made of frequency characteristics etc. of picked-up sound signals generated by the microphones 130, 131, 150, 151 during the stereo tone reproduction, based on the measuring tone signals S, by the rear speakers 160 and 161, in generally the same manner as in the measurement in the open loop condition. More specifically, stereophonically-reproduced measuring sounds are picked up by the microphones 130 and 150 of the L-channel AFC circuit block 250 and the microphones 131 and 151 of the R-channel AFC circuit block 350. Further, measured results of the picked-up sound signals generated by the microphones 130 and 150 (hereinafter referred to as "measured results SCL") are used to set the programmable equalizer 206 etc. of the L-channel AFC circuit block 250, while measured results of the picked-up tone signals generated by the microphones 131 and 151 (hereinafter referred to as "measured results SCR") are used to set the programmable equalizer 306 etc. of the R-channel AFC circuit block 350.

Then, signals, obtained at points immediately preceding the points of the L-channel and R-channel AFC circuit blocks 250 and 350 where the measuring tone signals S were received earlier, are supplied to the measuring circuit 403 as to-be-measured sound signals. Namely, signals having been delivered over the loops of the L-channel AFC circuit block 250 and R-channel AFC circuit block 350, including the interior space of the room, are supplied to the measuring circuit 403 as to-be-measured sound signals. As such to-be-measured sound signals are supplied to the measuring circuit 403, the measuring circuit 403 measures frequency characteristics and gains of each of the supplied to-be-measured sound signals. Namely, measurement is made of transmission characteristics, including transmission characteristics of the interior space of the room, and gain of the signal when the signal passageway of the L-channel AFC circuit block 250 is placed in the closed loop condition, and the measured results are supplied to the control section 401 and then stored in the RAM or the like. Also, measurement is made of transmission characteristics, including transmission characteristics of the interior space of the room, and gain of the signal when the signal passageway of the R-channel AFC circuit block 350 is placed in the closed loop condition, and the measured results are supplied to the control section 401 and then stored in the RAM or the like. Manner of performing the measurement is generally the same as in the above-described measurement in the open loop condition, and thus will not be described here to avoid unnecessary duplication.

Once measured results SCL and SCR of measuring tones sounded in the closed loop condition are obtained for the L-channel AFC circuit block 250 and R-channel AFC circuit block 350, the control section 401 corrects these measured results SCL and SCR on the basis of the measured results SBGL and SBGR obtained at step S3 above when no measuring tone was sounded at all, at step S6. In this way, the control section 401 acquires corrected measured results HSCL and HSCR. Manner of performing the measurement in the closed loop is generally the same as in the measurement in the open loop condition, and thus will not be described here to avoid unnecessary duplication.

Once the corrected measured results HSCL and HSCR with influences of background noise appropriately corrected or compensated for have been acquired, the control section 401 adjusts the characteristics of the preceding programmable equalizer 206 of the L-channel AFC circuit block 250 and the characteristics of the preceding programmable equalizer 306 of the R-channel AFC circuit block 350, at step S7. The characteristic correction of the programmable equalizers 206 and 306 is performed in generally the same manner as the above-described characteristic correction in the open loop condition. Namely, on the basis of the corrected measured result HSCL, the control section 401 adjusts the characteristics of the programmable equalizer 206 so that the frequency characteristics, representing the measured results, will be flattened within a howling-preventing level range when the same measurement is made while measuring tones are being generated in the closed loop condition. Similarly, the control section 401 adjusts the characteristics of the programmable equalizer 306 of the R-channel AFC circuit block 350 on the basis of the corrected measured result HSCR. Note that, after completion of the characteristic correction of the programmable equalizers 206 and 306, the attenuators 209 and 309 may be adjusted in generally the same manner as in the above-described adjustment in the open loop condition.

In the electronic keyboard instrument 100 of the present invention as having been described so far, tones corresponding to stereo tone signals generated in response to operation on the keyboard 120 are sounded or audibly reproduced via the main speakers 140 and 141. At that time, the stereophonically-reproduced tones are picked up by the microphones 130, 131, 150, 151 to generate picked-up sound signals, and the L-channel signal processing section 204 and R-channel signal processing section 304 perform processing on the picked-up sound signals, such as impartment of reverberation utilizing acoustic characteristics of an installation environment (e.g., the shape of the space) in which the electronic keyboard instrument 100 is installed; this arrangement can faithfully reproduce sounding effects peculiar to a natural musical instrument and reverberation produceable in an actual performing space. Whereas some of the conventional electronic keyboard instruments have the function of processing a tone signal of a piano tone color, generated thereby, to impart a reverberation feeling to the tone signal and audibly reproducing the reverberation-imparted tone signal, the electronic keyboard instrument 100 of the present invention is arranged in such a manner that not only a tone generated by the electronic keyboard instrument 100 but also a tone generated by another musical instrument can be picked up by the microphones 130, 131, 150, 151, subjected to a reverberation impartment process etc. and then audibly reproduced. Therefore, in an ensemble performance or the like, the described embodiment of the electronic keyboard instrument 100 achieves much superior acoustics of tones in a performing space as compared to the conventional electronic keyboard instruments.

The described embodiment of the electronic keyboard instrument 100 has the superior tone generating function as having been set forth above. To implement such a superior tone generating function, the electronic keyboard instrument 100 includes the L-channel and R-channel AFC circuit blocks 250 and 350 that perform signal processing such as reverberation impartment. However, depending on the installed conditions of the electronic keyboard instrument 100 (e.g., depending on whether the electronic keyboard instrument 100 is installed near a wall, in the center of a room, near a piece of furniture or the like), there may be caused acoustic problems or inconveniences, such as howling: thus the equalizers etc. of the L-channel and R-channel AFC circuit blocks 250 and 350 must be set optimally in accordance with the installed conditions as stated above. Upon receipt of an automatic adjustment instruction from the user, the electronic keyboard instrument 100, as set forth above, causes measuring tones to be sounded via the speakers corresponding to left and right channels (i.e., rear speakers 160 and 161) and performs automatic adjustment of the equalizers etc. on the basis of picked-up sound signals generated by the microphones 130, 131, 150, 151 picking up sounds during the stereophonic reproduction of the measuring tones. Namely, because the electronic keyboard instrument 100 performs the automatic adjustment of the equalizers etc. on the basis of data actually measured in the installation environment of the electronic keyboard instrument 100, the automatic adjustment can be performed in a manner optimal to the installation environment.

Further, in tone generating apparatus, such as the described embodiment of the electronic keyboard instrument 100, capable of L- and R-channel stereophonic tone reproduction, there would sometimes be caused so-called crosstalk, i.e. leakage of a signal component from one channel to another; for example, there is a possibility of a signal component of the L-channel leaking into the loop of the R-channel AFV circuit block 350. The described embodiment of the electronic keyboard instrument 100 can compensate for the crosstalk that would be caused due to the provision of the stereo reproduction function, by stereophonically reproducing the measuring tones, i.e. simultaneously reproducing the measuring tones of the L an R channels via the rear speakers 160 and 161. Namely, in the described embodiment of the electronic keyboard instrument 100, the stereophonically-reproduced measuring tones are picked up by the microphones of the L-channel AFC circuit block 250 and R-channel AFC circuit block 350, the picked-up sound signals are measured, and then the equalizers etc. of each of the individual AFC circuit blocks 250 and 350 are adjusted on the basis of measured results including signal components of the other channel. The crosstalk can be appropriately compensated for by such adjustment.

Further, in the described embodiment of the electronic keyboard instrument 100, the measured results of the picked-up sound signals generated by the microphones 130, 131, 150, 151 are subjected to a correction process to eliminate almost all influences of background noise, and the thus-corrected measured results are used in automatic adjustment of the equalizers of the L-channel AFC circuit block 250 and R-channel AFC circuit block 350. As a consequence, the automatic adjustment can be performed with an even further enhanced accuracy.

4. Modifications of the Invention:

It should be appreciated that the present invention is not limited to the above-described embodiment and may be modified variously as exemplified below.

(Modification 1)

Figure 6:
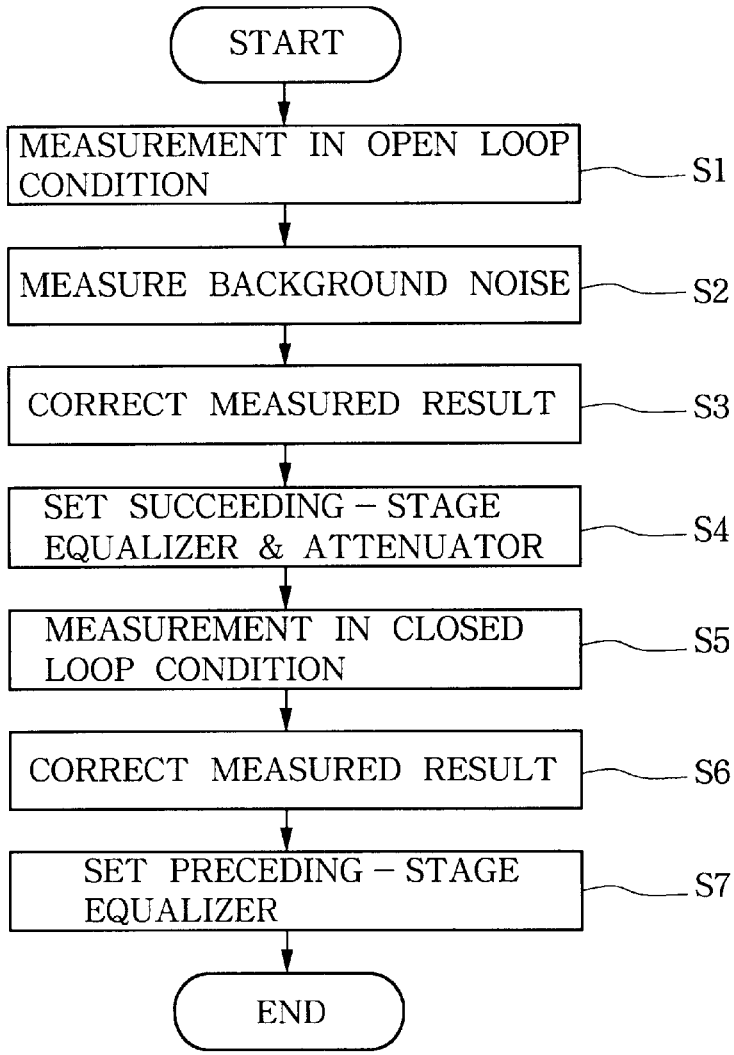
FIG. 6 is a flow chart showing an exemplary step sequence of AFC contents adjustment processing performed by the electronic keyboard instrument of FIG. 2.

The above-described embodiment is constructed to correct the measured results SCL and SCR in the closed loop condition on the basis of the measured results SBGL and SBGR of background noise in the open loop condition (step S6 of FIG. 6). Alternatively, background noise may be measured in the closed loop condition, and the measured results SCL and SCR in the closed loop condition may be corrected on the basis of the measured results, in the closed loop condition, of the background noise. Here, the measurement of the background noise in the closed loop condition may be performed, generally in the same manner as in the background noise measurement in the open loop condition, with the L-channel AFC circuit block 250 and R-channel AFC circuit block 350 placed in the closed loop condition. Further, the adjustment based on the measured results of the background noise in the closed loop condition may also be performed generally in the same manner as in the above-described embodiment.

(Modification 2)

The above-described embodiment of the electronic keyboard instrument 100 is constructed to generate measuring tones in its installation environment in response to user's automatic adjustment instructions and perform optimal adjustment of the equalizers etc. on the basis of measured results of the measuring tones obtained in that environment. Alternatively, there may be prestored, in the ROM of the control section 401, a table containing a plurality of pieces of optimal setting information for the equalizers and attenuators in association with a plurality of possible installation environments, and a particular one of the pieces of the setting information which correspond to a user-designated installation environment may be read out from the ROM so that the equalizers and attenuators can be adjusted in accordance with the read-out piece of setting information.

Here, each of the pieces of setting information comprises information for setting characteristics of the programmable equalizers 206 and 208 of the L-channel AFV circuit block 250, information for setting characteristics of the programmable equalizers 306 and 308 of the R-channel AFV circuit block 350, and information indicative of respective gain adjustment amounts of the attenuator 209 of the L-channel AFV circuit block 250 and attenuator 309 of the R-channel AFV circuit block 350.

Figure 10:
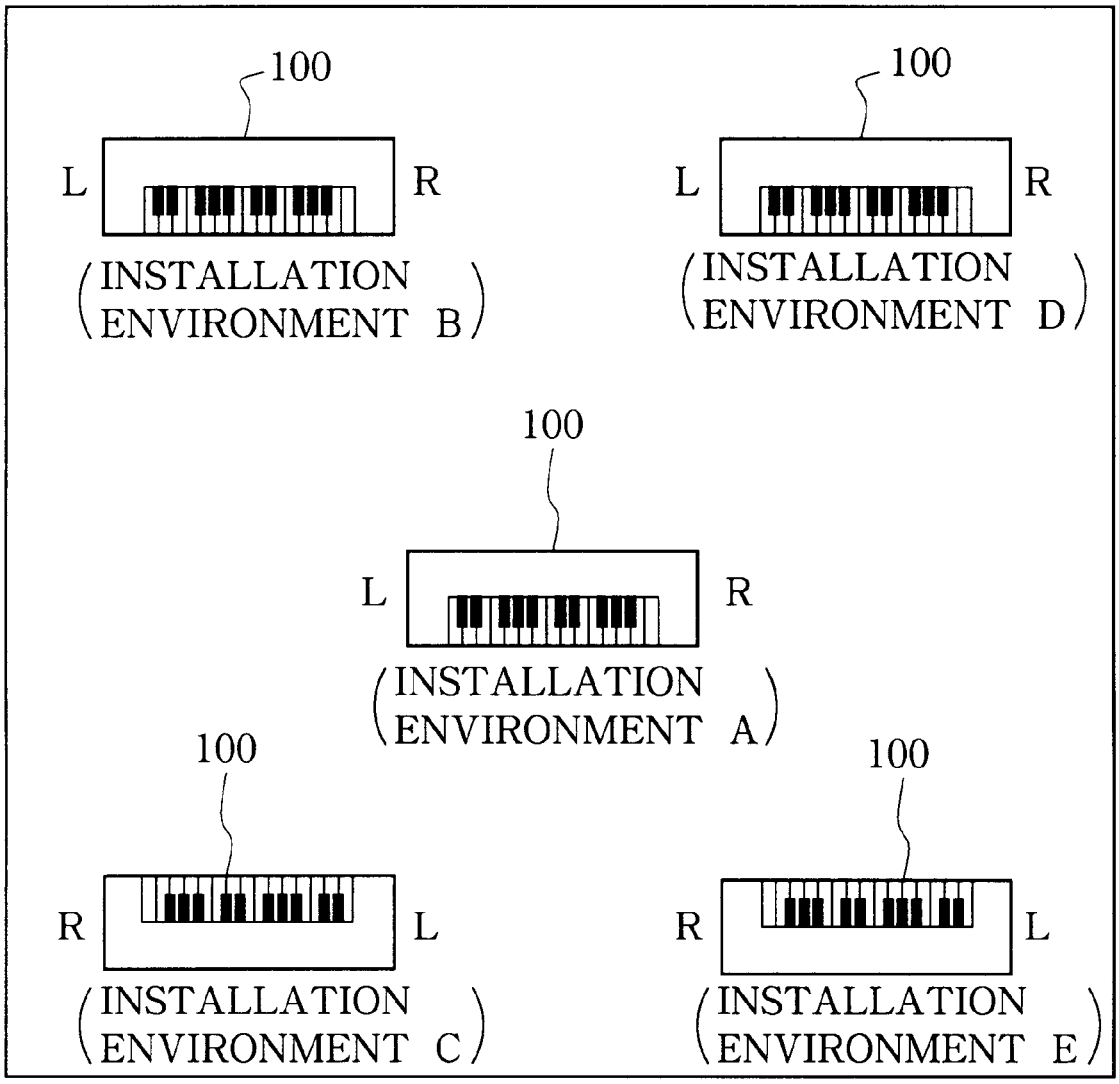
FIG. 10 is a diagram explanatory of contents of setting information contained in the table of FIG. 9.

The "installation environments" are each information indicating a particular shape of a room and a particular position in the room where the electronic keyboard instrument 100 is installed, and examples of the "installation environments" include, as illustratively shown in FIG. 10, installation environment A where the electronic keyboard instrument 100 is installed in the center of a room having a rectangular cross-sectional shape, installation environment B where the electronic keyboard instrument 100 is installed at one corner (upper left corner in FIG. 10) of the room, installation environment C where the electronic keyboard instrument 100 is installed at another corner (lower left corner in FIG. 10) of the room, installation environment D where the electronic keyboard instrument 100 is installed at still another corner (upper right corner in FIG. 10) of the room, and installation environment E where the electronic keyboard instrument 100 is installed at still another corner (lower right corner in FIG. 10) of the room. Pieces of the setting information corresponding to these five installation environments can be acquired in the following manner. Namely, the AFC contents adjustment processing, including adjustment in an open loop condition and adjustment in a closed loop condition, is performed in the same manner as in the above-described embodiment by placing the electronic keyboard instrument 100 in each of installation environment A to installation environment E, and settings of each of the equalizers and attenuators obtained through the adjustment processing are acquired as the setting information.

Once the user designates an installation environment closer to a desired actual installation environment under such arrangements, the equalizers and attenuators of the L-channel AFC circuit block 250 and R-channel AFC circuit block 350 are adjusted in accordance with the setting information corresponding to the user-designated installation environment. Therefore, it is possible to perform adjustment more suitable for the installation environment of the electronic keyboard instrument 100 and thus perform reverberation impartment etc. with almost no acoustic inconveniences involved. Further, in this case, no measurement as performed in the above-described embodiment is required for the adjustment processing, and therefore the total time necessary for the adjustment can be reduced significantly. Also, because the measuring circuit 403 is not required, the electronic keyboard instrument 100 can be significantly simplified in structure.

(Modification 3)

Whereas the present invention has been described above as applied to an electronic keyboard instrument that generates tones in response to operation on the keyboard 120, it is also applicable to other types of electronic musical instruments and electronic tone generating apparatus that electronically generate tones in response to operation on other types of music performing operators.

In summary, the present invention can impart an acoustic feeling etc. to tones to be generated utilizing acoustic conditions etc. of the interior of an existing room and can also automatically prevent occurrence of inconveniences or problems, such as howling, even when an installation environment or the like has varied.

What is claimed is:

1. An electronic tone generating apparatus comprising an electronic tone generator for generating tone signals of a first channel and second channel, and a first speaker and second speaker for audibly reproducing tones corresponding to the tone signals of said first channel and second channel, respectively, generated by said electronic tone generator, said electronic tone generating apparatus further comprising:

a first microphone provided at a position corresponding to said first speaker;

a second microphone provided at a position corresponding to said second speaker;

a first signal processing section that performs predetermined signal processing on a picked-up sound signal generated by said first microphone picking up a sound and thereby outputs a processed picked-up sound signal;

a second signal processing section that performs predetermines signal processing on a picked-up sound signal generated by said second microphone picking up a picked-up sound and thereby outputs a processed picked-up sound signal;

a third speaker provided at a position corresponding to said first speaker, said third speaker audibly reproducing a sound corresponding to the processed picked-up sound signal outputted by said first signal processing section;

a fourth speaker provided at a position corresponding to said second speaker, said fourth speaker audibly reproducing a sound corresponding to the processed picked-up sound signal outputted by said second signal processing section; and a setting section that, when an instruction for setting contents of signal processing is given, supplies a measuring sound signal to said third speaker and fourth speaker, and sets contents of the signal processing to be performed by said first signal processing section on the basis of a picked-up sound signal generated by said first microphone during a predetermined measuring period when sounds corresponding to the measuring sound signal are being audibly reproduced by said third speaker and fourth speaker, and contents of the signal processing to be performed by said second signal processing section on the basis of a picked-up sound signal generated by said second microphone during the predetermined measuring period.

2. An electronic tone generating apparatus as claimed in claim 1 wherein each of said first signal processing section and second signal processing section includes a first equalizer, FIR filter and second equalizer, and wherein when the instruction for setting contents of signal processing is given, said setting section performs a) adjustment processing in an open loop condition where signal passageways of said first signal processing section and second signal processing section are interrupted at respective given interrupting points thereof and during a period when said third speaker and fourth speaker are being caused to audibly reproduce sounds by receiving the measuring sound signal inputted via the interrupting points, said adjustment processing in the open loop condition measuring a frequency characteristic of a picked-up sound signal generated by said first microphone and fed back to the interrupting point of said first signal processing section and then adjusting a characteristic of said first equalizer of said first signal processing section so that a frequency characteristic of a picked-up sound signal subsequently generated by said first microphone becomes a flat characteristic, said adjustment processing in the open loop condition also measuring a frequency characteristic of a picked-up sound signal generated by said second microphone and fed back to the interrupting point of said second signal processing section and then adjusting a characteristic of said first equalizer of said second signal processing section so that a frequency characteristic of a picked-up sound signal subsequently generated by said second microphone becomes a flat characteristic, and b) adjustment processing in a closed loop condition where signal passage loops of said first signal processing section and second signal processing section are closed and during a period when said third speaker and fourth speaker are being caused to audibly reproduce sounds by receiving the measuring sound signal inputted via the interrupting points, said adjustment processing in the closed loop condition measuring a frequency characteristic of a picked-up sound signal generated by said first microphone and then adjusting a characteristic of said second equalizer of said first signal processing section so that a frequency characteristic of a picked-up sound signal subsequently generated by said first microphone becomes a flat characteristic, said adjustment processing in the closed loop condition also measuring a frequency characteristic of a picked-up sound signal generated by said second microphone and then adjusting a characteristic of said second equalizer of said second signal processing section so that a frequency characteristic of a picked-up sound signal subsequently generated by said second microphone becomes a flat characteristic.

3. An electronic tone generating apparatus as claimed in claim 2 wherein said setting section corrects the frequency characteristic measured of the picked-up sound signal, generated by said first microphone in each of the open loop condition and closed loop condition, on the basis of a picked-up sound signal generated by said first microphone while audible sound reproduction by said first, second, third and fourth speakers is stopped, and adjusts the characteristics of said first equalizer and second equalizer of said first signal processing section so that a frequency characteristic measured of a picked-up sound signal generated by said first microphone after correction of the frequency characteristic by said setting section becomes a predetermined flat characteristic, and wherein said setting section corrects the frequency characteristic measured of the picked-up sound signal, generated by said second microphone in each of the open loop condition and closed loop condition on the basis of a picked-up sound signal generated by said second microphone while audible sound reproduction by said first, second, third and fourth speakers is stopped, and adjusts the characteristics of said first equalizer and second equalizer of said second signal processing section so that a frequency characteristic measured of a picked-up sound signal generated by said second microphone after correction of the frequency characteristic by said setting section becomes a predetermined flat characteristic.

4. An electronic tone generating apparatus comprising an electronic tone generator for generating a tone signal, and a main speaker for audibly reproducing a tone corresponding to the tone signal generated by said electronic tone generator, said electronic tone generating apparatus further comprising:

a microphone provided at a position corresponding to said main speaker;

a signal processing section that performs predetermined signal processing on a picked-up sound signal generated by said microphone and thereby outputs a processed picked-up sound signal, said signal processing section including a first equalizer, FIR filter and second equalizer;

an auxiliary speaker for audibly reproducing a tone corresponding to the processed picked-up sound signal outputted by said signal processing section; and a setting section that, when an instruction for setting contents of signal processing is given, sets contents of the signal processing to be performed by said signal processing section, said setting section performing a) adjustment processing in an open loop condition where said signal processing section is interrupted at a given interrupting point thereof and during a time period in which said auxiliary speaker is being caused to audibly reproduce a sound by receiving a measuring sound signal inputted via the interrupting point, said adjustment processing in the open loop condition measuring a frequency characteristic of a picked-up sound signal generated by said microphone and fed back to the interrupting point of said signal processing section, then correcting the measured frequency characteristic on the basis of a picked-up signal generated by said microphone while audible sound reproduction by said main speaker and auxiliary speaker is stopped, and then adjusting a characteristic of said first equalizer of said signal processing section so that a measured frequency characteristic of a sound signal after correction of the measured frequency characteristic by said setting section becomes a flat characteristic, and b) adjustment processing in a closed loop condition where a signal passage loop of said signal processing section is closed and during a time period in which said auxiliary speaker is being caused to audibly reproduce a sound by receiving the measuring sound signal inputted via the interrupting point, said adjustment processing in the closed loop condition measuring a frequency characteristic of a picked-up sound signal generated by said microphone, then correcting the measured frequency characteristic on the basis of a picked-up signal generated by said microphone while audible sound reproduction by said main speaker and auxiliary speaker is stopped, and then adjusting a characteristic of said second equalizer of said signal processing section so that a frequency characteristic of a picked-up sound signal generated by said microphone after correction of the measured frequency characteristic by said setting section becomes a flat characteristic.

5. An electronic tone generating apparatus as claimed in claim 1 wherein the measuring sound signal supplied by said setting section is a signal for generating a chord of a predetermined tone color.

6. An electronic tone generating apparatus as claimed in claim 1 wherein the measuring sound signal supplied by said setting section is a signal for generating a tone containing frequency components of a relatively wide band.

7. An electronic tone generating apparatus as claimed in claim 1 wherein when the instruction for setting contents of signal processing is given, said setting section supplies, as the measuring sound signal, a signal for generating chords of a predetermined tone color for a predetermined time period, and a signal to cause constituent tones of the chords generated during the predetermined time shift from relatively high pitches to lower pitches and then returns to relatively high pitches.

8. An electronic tone generating apparatus as claimed in claim 1 which further comprises a performing operator, and wherein said electronic tone generator generates a tone signal corresponding to an operated state of said performing operator.

9. A method for adjusting signal processing characteristics of a first signal processing section and second signal processing section included in an electronic tone generating apparatus which comprises: an electronic tone generator for generating tone signals of a first channel and second channel; a first speaker and second speaker for audibly reproducing tones corresponding to the tone signals of said first channel and second channel, respectively, generated by said electronic tone generator, a first microphone provided at a position corresponding to said first speaker; a second microphone provided at a position corresponding to said second speaker; said first signal processing section that performs predetermined signal processing on a picked-up sound signal generated by said first microphone picking up a sound and thereby outputs a processed picked-up sound signal; said second signal processing section that performs predetermined signal processing on a picked-up sound signal generated by said second microphone picking up a sound and thereby outputs a processed picked-up sound signal; a third speaker provided at a position corresponding to said first speaker, said third speaker audibly reproducing a sound corresponding to the processed picked-up sound signal outputted by said first signal processing section; and a fourth speaker provided at a position corresponding to said second speaker, said fourth speaker audibly reproducing a sound corresponding to the processed picked-up sound signal outputted by said second signal processing section, said method comprising:

a step of, when an instruction for setting contents of signal processing is given, supplying a measuring sound signal to said third speaker and fourth speaker, and a step of setting contents of the signal processing to be performed by said first signal processing section on the basis of a picked-up sound signal generated by said first microphone during a predetermined measuring period when sounds corresponding to the measuring sound signal are being audibly reproduced by said third speaker and fourth speaker, and contents of the signal processing to be performed by said second signal processing section on the basis of a picked-up sound signal generated by said second microphone during the predetermined measuring period.

10. A method as claimed in claim 9 wherein each of said first signal processing section and second signal processing section includes a first equalizer, FIR filter and second equalizer, and which further comprises a step of, when the instruction for setting contents of signal processing is given, performing a) adjustment processing in an open loop condition where signal passageways of said first signal processing section and second signal processing section are interrupted at respective given interrupting points thereof and during a period when said third speaker and fourth speaker are being caused to audibly reproduce sounds by receiving the measuring sound signal inputted via the interrupting points, said adjustment processing in the open loop condition measuring a frequency characteristic of a picked-up sound signal generated by said first microphone and fed back to the interrupting point of said first signal processing section and then adjusting a characteristic of said first equalizer of said first signal processing section so that a frequency characteristic of a picked-up sound signal subsequently generated by said first microphone becomes a flat characteristic, said adjustment processing in the open loop condition also measuring a frequency characteristic of a picked-up sound signal generated by said second microphone and fed back to the interrupting point of said second signal processing section and then adjusting a characteristic of said first equalizer of said second signal processing section so that a frequency characteristic of a picked-up sound signal subsequently generated by said second microphone becomes a flat characteristic, and b) adjustment processing in a closed loop condition where signal passage loops of said first signal processing section and second signal processing section are closed and during a period when said third speaker and fourth speaker are being caused to audibly reproduce sounds by receiving the measuring sound signal inputted via the interrupting points, said adjustment processing in the closed loop condition measuring a frequency characteristic of a picked-up sound signal generated by said first microphone and then adjusting a characteristic of said second equalizer of said first signal processing section so that a frequency characteristic of a picked-up sound signal subsequently generated by said first microphone becomes a flat characteristic, said adjustment processing in the closed loop condition also measuring a frequency characteristic of a picked-up sound signal generated by said second microphone and then adjusting a characteristic of said second equalizer of said second signal processing section so that a frequency characteristic of a picked-up sound signal subsequently generated by said second microphone becomes a flat characteristic.

11. A method for adjusting a signal processing characteristic of a signal processing section included in an electronic tone generating apparatus which comprises: an electronic tone generator for generating a tone signal; a main speaker for audibly reproducing a tone corresponding to the tone signal generated by said electronic tone generator; a microphone provided at a position corresponding to said main speaker; said signal processing section that performs predetermined signal processing on a picked-up sound signal generated by said microphone and thereby outputs a processed picked-up sound signal, said signal processing section including a first equalizer, FIR filter and second equalizer; and an auxiliary speaker for audibly reproducing a sound corresponding to the processed picked-up sound signal outputted by said signal processing section, said method comprising:

a step of, when an instruction for setting contents of signal processing is given, performing a) adjustment processing in an open loop condition where said signal processing section is interrupted at a given interrupting point thereof and during a time period in which said auxiliary speaker is being caused to audibly reproduce a sound by receiving a measuring sound signal inputted via the interrupting point, said adjustment processing in the open loop condition measuring a frequency characteristic of a picked-up sound signal generated by said microphone and fed back to the interrupting point of said signal processing section, then correcting the measured frequency characteristic on the basis of a picked-up signal generated by said microphone while audible sound reproduction by said main speaker and auxiliary speaker is stopped, and then adjusting a characteristic of said first equalizer of said signal processing section so that a measured frequency characteristic of a sound signal after correction of the measured frequency characteristic by said setting section becomes a flat characteristic, and b) adjustment processing in a closed loop condition where a signal passage loop of said signal processing section is closed and during a time period in which said auxiliary speaker is being caused to audibly reproduce a sound by receiving the measuring sound signal inputted via the interrupting point, said adjustment processing in the closed loop condition measuring a frequency characteristic of a picked-up sound signal generated by said microphone, then correcting the measured frequency characteristic on the basis of a picked-up signal generated by said microphone while audible sound reproduction by said main speaker and auxiliary speaker is stopped, and then adjusting a characteristic of said second equalizer of said signal processing section so that a frequency characteristic of a picked-up sound signal generated by said microphone after correction of the measured frequency characteristic by said setting section becomes a flat characteristic.

* * * * *